US010603563B2

(12) United States Patent
Frank et al.

(10) Patent No.: US 10,603,563 B2
(45) Date of Patent: Mar. 31, 2020

(54) FLOTATION DEVICE

(71) Applicant: Jordan Frank, Providence, RI (US)

(72) Inventors: Jordan Frank, Providence, RI (US); Jeanette Numbers, Providence, RI (US); Rance Pritchard, Providence, RI (US); Chandlyr Jackson, Providence, RI (US)

(73) Assignee: Jordan Frank, Providence, RI (US)

( * ) Notice: Subject to any disclaimer, the term of this patent is extended or adjusted under 35 U.S.C. 154(b) by 0 days.

(21) Appl. No.: 15/962,538

(22) Filed: Apr. 25, 2018

(65) Prior Publication Data

US 2018/0326279 A1 Nov. 15, 2018

Related U.S. Application Data

(60) Provisional application No. 62/506,559, filed on May 15, 2017.

(51) Int. Cl.
*A63B 69/14* (2006.01)
*A63B 31/12* (2006.01)
(Continued)

(52) U.S. Cl.
CPC ..... *A63B 69/14* (2013.01); *A63B 31/00* (2013.01); *A63B 31/10* (2013.01); *A63B 31/12* (2013.01);
(Continued)

(58) Field of Classification Search
CPC ..... A63B 31/00; A63B 31/12; A63B 35/02; A63B 35/00; A63B 31/10; A63B 31/11;
(Continued)

(56) References Cited

U.S. PATENT DOCUMENTS 739,909 A 9/1903 Ogle et al.
D217,644 S 5/1970 Smith
(Continued)

FOREIGN PATENT DOCUMENTS

KR 20160084350 A 7/2016

OTHER PUBLICATIONS

Frank, J., International Application No. PCT/US2018/029301, International Search Report and Written Opinion, dated Aug. 10, 2018, 12 pages.
(Continued)

*Primary Examiner* — Lars A Olson
(74) *Attorney, Agent, or Firm* — LaBatt, LLC

(57) ABSTRACT

A flotation device, particularly suitable for use as a pull buoy or a kickboard is described. The flotation device can include a flotation element and a stem element, which extends from an inner surface of the flotation element. A holding mechanism can be located adjacent to the second end of the stem element. The stem element and holding mechanism can be configured to enable a user to hold onto the flotation device at a point below the surface of the water for use as a kickboard or enable a user to secure the stem element of the flotation device between his/her legs for use as a pull buoy. An embodiment of the stem element can be tapered, which can create forces that assist the user in using the flotation device as either a pull buoy or a kickboard.

21 Claims, 9 Drawing Sheets

(51) Int. Cl.
*A63B 31/10* (2006.01)
*A63B 31/00* (2006.01)

(52) U.S. Cl.
CPC ..... *A63B 2208/03* (2013.01); *A63B 2225/09* (2013.01); *A63B 2225/605* (2013.01)

(58) Field of Classification Search
CPC ..... A63B 69/00; A63B 69/12; A63B 69/14; B63C 9/00; B63C 9/08
USPC ..... 441/60, 88
See application file for complete search history.

(56) References Cited

U.S. PATENT DOCUMENTS

| | | | | |
|---|---|---|---|---|
| 3,604,023 | A | 9/1971 | Lynch | |
| 4,362,518 | A | 12/1982 | Boissiere | |
| 4,379,704 | A | 4/1983 | Rademacher | |
| 4,929,205 | A | 5/1990 | Jones | |
| 5,092,802 | A | 3/1992 | Jones | |
| D345,668 | S | 4/1994 | Braly | |
| 5,878,453 | A | 3/1999 | Stokes | |
| D408,677 | S | 4/1999 | Pamham | |
| 6,436,014 | B1 | 8/2002 | Cirjak | |
| 6,793,549 | B1 | 9/2004 | Chiang | |
| 7,169,000 | B1 | 1/2007 | Hernandez et al. | |
| 7,379,704 | B2 | 5/2008 | Parker et al. | |
| D579,706 | S | 11/2008 | Cox et al. | |
| D653,486 | S | 2/2012 | Wood | |
| D728,970 | S | 5/2015 | Gilroy | |
| D736,882 | S | 8/2015 | Chen | |
| D739,909 | S | 9/2015 | Mix et al. | |
| 9,259,632 | B2 | 2/2016 | DiLorenzo et al. | |
| 9,278,257 | B2 | 3/2016 | Kacar | |
| D763,601 | S | 8/2016 | Hill | |
| 9,522,303 | B2 * | 12/2016 | Kim | A63B 31/12 |
| D775,863 | S | 1/2017 | Jensen | |
| 2008/0081526 | A1 | 4/2008 | Hagedorn | |
| 2013/0074269 | A1 | 3/2013 | Phillips, II | |
| 2013/0344756 | A1 | 12/2013 | Day | |
| 2014/0030940 | A1 | 1/2014 | Day | |
| 2015/0258386 | A1 | 9/2015 | Kim | |
| 2015/0283447 | A1 | 10/2015 | DiLorenzo et al. | |
| 2015/0290500 | A1 | 10/2015 | Clisson | |
| 2015/0343267 | A1 | 12/2015 | Kacar | |
| 2016/0114234 | A1 | 4/2016 | DiLorenzo et al. | |
| 2016/0175655 | A1 | 6/2016 | Kacar | |
| 2018/0008875 | A1 | 1/2018 | Frank | |

OTHER PUBLICATIONS

Axis, "Dual-Function Pull Buoy," Accessed Apr. 20, 2017, 1 page, FINISinc.com.

Aquagear, "Aqua Sphere P2K Pull Buoy Kickboard Combo," Accessed Apr. 20, 2017, 1 page, www.aquagear.com/aqua-sphere-p2k/.

Aqua Sphere, "Classic Pull Buoy," Accessed Apr. 20, 2017, 1 page, www.aquaspherewim.com/us/training-gear/item/135-classic-pull-buoy.

Aqua Sphere, "ErgoBuoy," Accessed Apr. 20, 2017, 1 page, www.aquaspherewim.com/us/men/men-training-gear/training-gear-men-swim-training/erobuoy.

Chloe, "SwimRun Gear," SwimRun Gear—Love SwimRun, Jan. 28, 2016, 8 pages, <URL: https://web.archive.org/web/20160126173658/http://loveswimrun.co.uk/gear></URL:>.

Huub, "Big Buoy 4—Pull Buoy," Jul. 18, 2017, 2 pages, https://www.huubusa.com/collections/swim-accessories/products/huub-u.

Huub, "HUUB Kickboard," Jul. 18, 2017, 2 pages, https://www.huubusa.com/collections/swim-accessories/products/huub-u.

Kemp USA, "Kemp USA Adjustable Pull Buoy," Accessed Apr. 20, 2017, 1 page, www.kempusa.com/kemp-usa-adjustable-pull-buoy.

Tritan Swim Tech, "Pull Buoy," Accessed Apr. 20, 2017, 1 page, BetterTimes.org.

Speedo, "Team Pull Buoy," Accessed Apr. 20, 2017, 3 pages, www.speedousa.com/team-pull-buoy-style-7753023.

Swim Keel, "Swim Keel—SKU: 1E358," Jul. 18, 2017, 3 pages, https://www.arenawaterinstinct.com/en_global/swim-keel.html.

swimrunshop.com, "SwimRunners Belt—Guidance Team Kit," Jul. 18, 2017, 5 pages, http://swimrunshop.com/product/swimrunners-pull-belt-guidance-team-ki.

swimrunshop.com, "SwimRunners Pull Buoy—Orange," Jul. 18, 2017, 5 pages, http://swimrunshop.com/product/swimrunners-pull-buoy-orange/.

"SwimRun Pull Buoy Modification," YouTube Video Capture, 2016, 1 page.

Frank, J., International Application No. PCT/US2017/039413, International Search Report and Written Opinion, dated Sep. 21, 2017, 13 pages.

Venne, D., U.S. Appl. No. 15/634,119, Office Action 2, dated Jan. 17, 2019, 10 pages.

Venne, D., U.S. Appl. No. 15/634,119, Office Action1, dated May 4, 2018, 23 pages.

Chloe, "SwimRun Gear," SwimRun Gear—Love SwimRun, Nov. 10, 2015, 8 pages, <URL: https://web.archive.org/web/20160126173658/http://loveswimrun.co.uk/gear></URL:>.

Venne, D., U.S. Appl. No. 15/634,119, Final Rejection, dated Oct. 9, 2018, 8 pages.

Davis, M., U.S. Appl. No. 29/604,130, Notice of Allowance, dated Jun. 6, 2018, 18 pages.

Venne, D., U.S. Appl. No. 15/634,119, Final Office Action, dated Jun. 3, 2019, 10 pages.

Venne, D, U.S. Appl. No. 15/634,119, Office Action 3, dated Nov. 20, 2019, 8 pages.

Venne, D., U.S. Appl. No. 15/634,119, Ex parte Quayle Action, Jan. 17, 2020, 5 pages.

Venne, D., U.S. Appl. No. 15/634,119, Notice of Allowance, dated Feb. 3, 2020, 7 pages.

* cited by examiner

FLOTATION DEVICE

REFERENCE TO RELATED APPLICATIONS

The current application claims the benefit of U.S. Provisional Application No. 62/506,559, filed on 15 May 2017, which is hereby incorporated by reference.

TECHNICAL FIELD

The present invention pertains to flotation aids used in swimming, and more particularly to a flotation device designed to be used alternately as a pull buoy or kickboard.

BACKGROUND ART

Numerous flotation aids for use in swimming are available. One commonly used flotation device is a pull buoy, which can be used to immobilize and float a swimmer's legs in order to allow the swimmer to focus on his/her upper body motions. Existing pull buoy solutions require varying degrees of inconveniences while swimming. The predominant design is a singular figure eight form that the swimmer places between his/her thighs. This requires the swimmer to squeeze his/her thighs tightly to keep the buoy in place. The buoy requires frequent placement adjustments while swimming and is especially difficult to keep in place when kicking off a wall of a pool to change direction. Other pull buoys involve an ankle cuff with openings on the outside of each ankle cylinder which allows the swimmer to insert or remove his/her ankles from the buoy.

Another commonly used flotation device is a kickboard, which can be used to allow the swimmer to focus on his/her lower body motions. The predominant kickboard designs involve a floating board or foam shape which the swimmer holds at surface level. This design requires the swimmer to assume an upright position with arms at water surface level and upper body and head above water. This position differs from a more hydrodynamic form when engaging in a crawl stroke where the head is facing underwater and hands target a position that is many inches below water surface at the farthest reach point.

In training sessions, swimmers will often do intervals where they switch between using a pull buoy, a kickboard, and other training devices. The swimmers often do not have much time to make the change before starting their next interval.

SUMMARY OF THE INVENTION

In view of the above, the inventor recognizes a need to offer the swimmer a flotation device that may be used as a pull buoy, placed between his/her thighs. Embodiments of a flotation device described herein can be configured to fit snugly between the thighs, so that the swimmer can use the device without concern that the flotation device will slide back towards the feet or require adjustment.

The inventor also recognizes a need for a flotation device that may be used as a kickboard, where the leading hand of the swimmer reaches towards a point below, rather than at, the surface of the water. This format supports a natural, hydrodynamic position and works well for common drills, such as the "catch-up" drill where the swimmer keeps one hand forward until the second hand completes a full stroke.

Embodiments of a flotation device described herein can incorporate the pull buoy and kickboard concepts into a single coherent design of a flotation device, which supports alternating pull buoy and kickboard drills with a single flotation device.

Embodiments of a flotation device described herein can include, when used as a pull buoy, a horizontal flotation element that rests above the thighs, a vertical stem element that extends from the flotation element down to a final element which includes a horizontal bar or span that extends between the lower part of the swimmer's thighs. The differential of water flow below and above the swimmer's legs can serve to put rotational pressure on the bottom and top of the pull buoy construction, tilting the surface level element forward and creating a lock. While the flotation element is typically described as being located at the water surface when used as a pull buoy, it is understood that this is only illustrative and the flotation element can be located below the water surface with the horizontal bar or span located at the water surface.

Embodiments of a flotation device described herein can include a tapered shape for the stem that, when used as a pull buoy, includes a region that is wider near the swimmer's upper thigh and more narrow on the point facing the feet. In this configuration, when the swimmer squeezes the stem, the stem naturally moves towards the swimmer's trunk rather than slipping towards the swimmer's legs.

Embodiments of a flotation device described herein can include a tapered shape for the stem that, when used as a pull buoy, includes a region that is narrower near the swimmer's upper thigh and wider on the point facing the feet. When in use as a pull buoy in this configuration, the taper of the stem can counteract the water flow, causing the stem to move towards the swimmer's trunk.

Embodiments of a flotation device described herein can include, when used as a kickboard, a horizontal flotation element, a vertical stem element that extends from the flotation element downwards below the water's surface, and a sub surface element on the stem which can be held by one or two hands. In this form, the swimmer's hand(s) hold an element of the pull buoy located below the surface. Use of the flotation device in this manner can mimic a swimmer's actual form when doing the crawl and comes without the hydrodynamic sacrifice when a swimmer's head and shoulders are above the surface when using a traditional kickboard.

Embodiments of a flotation device described herein provide a combination of the above aspects where a single device satisfies as both pull buoy and kickboard.

Embodiments of a flotation device described herein can be made of a variety of materials. In an embodiment, the surface element can be made of a foam material while the stem could be a hollow molded plastic piece. However, it is understood that the flotation device can be formed of any combination of materials providing a desired buoyancy.

To this extent, a flotation device, particularly suitable for use as a pull buoy or a kickboard, is described herein. The flotation device can include a flotation element and a stem element, which extends from an inner surface of the flotation element. A holding mechanism can be located adjacent to the second end of the stem element. The stem element and holding mechanism can be configured to enable a user to hold onto the flotation device at a point below the surface of the water for use as a kickboard or enable a user to secure the stem element of the flotation device between his/her legs for use as a pull buoy. An embodiment of the stem element can be tapered, which can create forces that assist the user in using the flotation device as either a pull buoy or a kickboard.

A first aspect of the invention provides a flotation device comprising: a flotation element having an inner surface; a stem element having a first end extending from the inner surface of the flotation element, wherein the stem element is formed of a rigid material, and wherein a primary axis of the stem element is approximately perpendicular to the flotation element along a front-back centerline of the flotation device; and a holding mechanism located adjacent to a second end of the stem element, opposite the first end.

A second aspect of the invention provides a flotation device, comprising: a stem element configured to be held between a swimmer's legs wherein at least a portion of the stem element is tapered from a region of the stem element located between the swimmer's leg's on a side closer to the swimmer's waist towards an end of the stem element located on a side closer to the swimmer's feet.

A third aspect of the invention provides a flotation device comprising: a flotation element having an inner surface with a front side and a back side; a stem element having a first end extending from the inner surface of the flotation element, and wherein a primary axis of the stem element is approximately perpendicular to the flotation element along a front-back centerline of the flotation element; and a holding mechanism located adjacent to a second end of the stem element, opposite the first end, wherein the holding mechanism includes a pair of horizontal protrusions, each horizontal protrusion extending from a lateral side of the stem element between approximately three inches and approximately fourteen inches.

The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

FIGS. 2A-2B show a perspective and exploded view of a three piece flotation device including a triangular buoyant shape, a stem and a locking piece according to an embodiment, while

DETAILED DESCRIPTION OF THE INVENTION

As indicated above, aspects of the invention provide for a flotation device, which can be used as a swimming pull buoy or kickboard. In illustrative embodiments, the flotation device includes at least one horizontal flotation surface with at least one stem. In the case that the stem has a surface, handle or hole for a hand hold it may be used as a kickboard where the hand is supported under-water instead of at the surface as is the case in a traditional kickboard. In the case that the stem has horizontal protrusion(s) near the bottom, the device can be used as a pull buoy as the protrusion(s) will provide the necessary means to squeeze and hold the flotation device between the swimmer's thighs. In the case that the protrusion(s) spans adequately near to the center point of the thighs, the pull buoy will lock into place and require little to no effort by the swimmer to maintain its position.

Figure 1A:
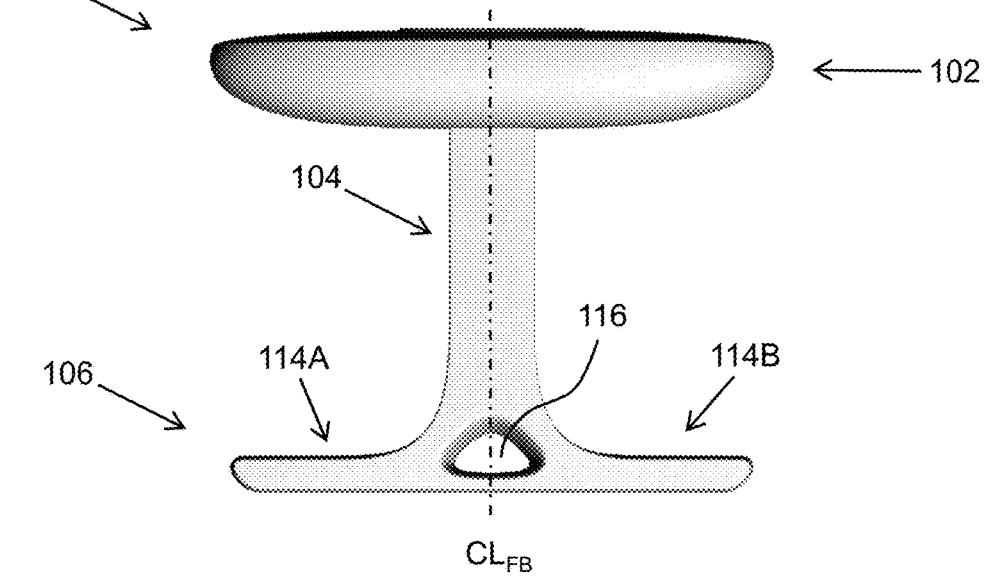
FIGS. 1A-1C show front, bottom, and side views of an illustrative flotation device according to an embodiment.
Figure 1B:
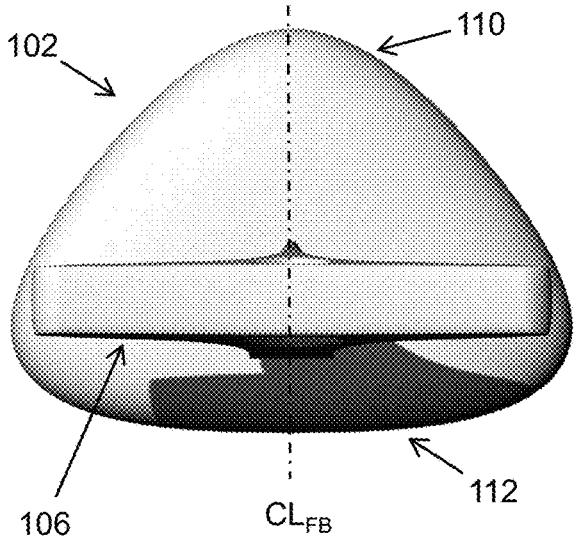
Figure 1C:
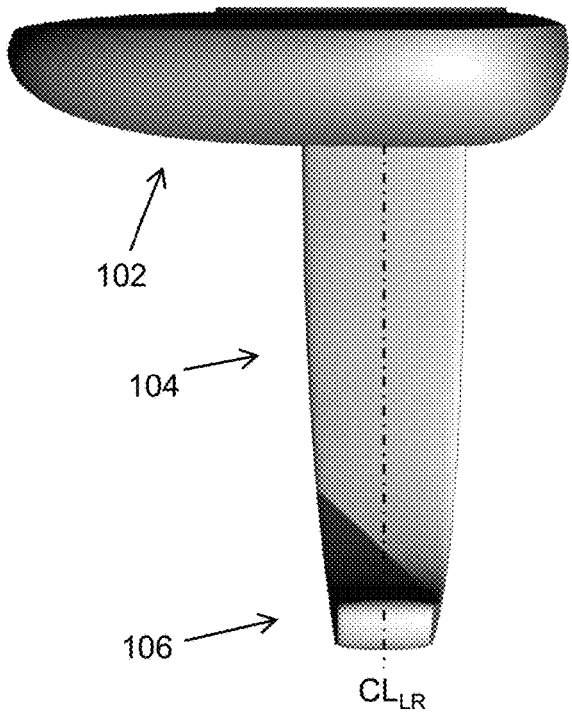

Turning to the drawings, FIGS. 1A, 1B and 1C show front, bottom, and side views, respectively, of an illustrative flotation device 100 according to an embodiment. The flotation device 100 is configured to be utilized as either a pull buoy or a kickboard. To this extent, the flotation device 100 includes a flotation element 102, a stem element 104, and a holding mechanism 106. As illustrated most clearly in FIG. 1B, the flotation device 100 has a front side 110 and a back side 112 and a front-back centerline $CL_{FB}$. The stem element 104 can extend from a bottom (inner) surface of the flotation element 102. As shown in FIG. 1A, the stem element 104 can be approximately perpendicular with the respect to the lateral left-right width of the flotation element 102 along the front-back centerline $CL_{FB}$. In a more particular embodiment, one or more of the flotation element 102, the stem element 104, and/or the holding mechanism 106 can be symmetrical on both sides of the front-back centerline $CL_{FB}$.

In an embodiment, the flotation element 102 can be formed of a foam or molded rubber element 102, which approximates the size and shape of a standard kickboard and may provide most of the flotation for the flotation device 100. In an illustrative embodiment, the flotation element 102 is formed from at least one of: silicone, polyethylene foam, ethylene-vinyl acetate (EVA), neoprene, and/or the like. As illustrated, the flotation element 102 can have a lateral triangular shape, which tapers from the back side 112 to the front side 110. However, it is understood that this is only illustrative of various possible shapes for the flotation element 102. For example, an embodiment of the flotation element 102 can have a lateral diamond shape, in which the central region is the widest and tapers to both the back side 112 and the front side 110. In this case, each taper can be the same or different. In still another embodiment, the flotation element 102 can have a lateral circular or elliptical shape. Additionally, it is understood that reference to the front side 110 and back side 112 is for convenience only. To this extent, when in use, the back side 112 may be facing the current while the front side 110 is located away from the flow of the current. Similarly, while the flotation device 100 is also described as having a top, bottom, left, and right, it is understood that this orientation is used for clarity in describing attributes of the flotation device 100 shown in the drawings. To this extent, it is understood that the flotation device 100 and other embodiments of flotation devices described herein can be used and/or configured for use in any orientation.

In an illustrative embodiment, a front-back height of the flotation element 102 and a left-right width of the flotation element 102 are between approximately five inches and approximately twenty-four inches. In a more particular illustrative embodiment, the front-back height and the left-right width of the flotation element 102 are between approximately six inches and approximately eighteen inches. In a still more particular illustrative embodiment, the front-back height and the left-right width of the flotation element 102 are between approximately six inches and approximately thirteen inches. In a still more particular illustrative embodiment, the front-back height is between approximately six inches and approximately ten inches, while the left-right width is between approximately nine inches and approximately thirteen inches.

In an embodiment, a total lateral surface area for the flotation element 102 is between approximately 25 square inches and approximately 576 square inches. In a more particular embodiment, the total lateral surface area for the flotation element is between approximately 36 square inches and approximately 324 square inches. In a still more particular embodiment, the total lateral surface area for the flotation element is between approximately 36 square inches and approximately 144 square inches. In an illustrative embodiment of the flotation element 102, the front-back height is approximately 8.6 inches, the left-right width is approximately 10.3 inches, and the total lateral surface area is approximately 45 square inches. In another illustrative embodiment of the flotation element 102, the front-back height is approximately 7.4 inches, the left-right width is approximately 11.6 inches, and the total lateral surface area is approximately 43 square inches.

The stem element 104 can extend from a location of the bottom (inner) surface of the flotation device 102 that is located in the back half of the flotation device 102. In an illustrative embodiment, a center of the stem element 104 is located approximately one third from the back side 112 of the flotation device 102. As illustrated most clearly in FIG. 1C, the stem 104 can have an approximately perpendicular orientation with respect to the front-back height of the flotation element 102. Additionally, the stem element 104 and/or the holding mechanism 106 can be symmetrical on either side of a left-right centerline $CL_{LR}$ of the stem element 104. However, it is understood that other orientations are possible. For example, the stem element 104 can be oriented such that the bottom of the stem element 104 (with the holding mechanism 106) is further back from the flotation element 102 than the location at which the top of the stem element 104 extends from the flotation element 102.

As discussed herein, the stem element 104 can have a dimension that is suitable for using the flotation device 100 as both a pull buoy and a kickboard. In an embodiment, the stem element 104 has a dimension selected such that the flotation element 102 and the holding mechanism 106 are spaced to comfortably and securely hold the flotation device 100 between the thighs of a swimmer. In an illustrative embodiment, the stem element 104 has a length between approximately one half of a left-right width of the flotation element 102 and approximately one and one-third the left-right width of the flotation element 102. In a more particular embodiment, the stem element 104 extends downward from the bottom of the flotation element 102 in a range between approximately four inches and approximately fourteen inches. In a still more particular embodiment, the stem element 104 extends downward from the bottom of the flotation element 102 in a range between approximately six inches and approximately twelve inches. In an embodiment, a total depth of the flotation device is between approximately seven inches and approximately twelve inches.

As discussed herein, the holding mechanism 106 can be configured to enable the flotation device 100 to be used as both a pull buoy and a kickboard. To this extent, the holding mechanism 106 can be configured to allow the stem element 104 of the flotation device 100 to be placed between the legs of a swimmer and held in place by surface tension between the legs of the swimmer and the flotation element 102 and the holding mechanism 106. In this case, the holding mechanism 106 can include one or more protrusions 114A, 114B. A protrusion 114A, 114B can extend laterally left or right from the stem 104 and have a lateral orientation approximately parallel with the lateral orientation of the floating element 102. In an illustrative embodiment, a protrusion 114A, 1146 extends from the stem element 104 a distance between approximately three inches and approximately fourteen inches. In a more particular embodiment, a protrusion 114A, 1146 extends from the stem 104 a distance between approximately four inches and approximately seven inches.

When used as a kickboard, a swimmer can hold the protrusions 114A, 114B with both hands. In an embodiment, the holding mechanism 106 can be configured to allow the swimmer to hold onto the holding mechanism 106 with only one hand in a manner that does not cause the flotation device 100 to become disoriented when in use. To this extent, the holding mechanism 106 can include an opening 116 located adjacent to a bottom of the stem element 104. As illustrated, the opening 116 can be located along a front-back centerline $CL_{FB}$ of the flotation device 100, thereby providing a central location at which the swimmer can hold onto the flotation device 100 with one hand. The opening 116 can have any size and/or shape suitable for allowing the swimmer to grasp the holding mechanism 106. While an opening 116 is shown, it is understood that this is only illustrative of various possible mechanisms for grasping the holding mechanism 106. For example, in an alternative embodiment, the holding mechanism 106 can comprise a handle located adjacent to the bottom of the stem element 104.

The stem element 104 and holding mechanism 106 can be formed of any suitable material. In an embodiment, the entire flotation device 100 is formed of a single molded material. Alternatively, the stem element 104 and holding mechanism 106 can be formed of a material more rigid than the material forming the flotation element 102, such as a molded rigid plastic. The stem element 104 and/or the holding mechanism 106 can be solid or have a hollow interiors.

In still other embodiments, a total distance between a bottom of the flotation element 102 and a top of the holding mechanism 106 can be adjustable. To this extent, the stem element 104 can be attached to one or both of the flotation element 102 and/or the holding mechanism 106 using an attachment solution that allows for selective vertical movement of the flotation element 102 and/or the holding mechanism 106 along the height of the stem element 104. For example, the flotation element 102 and/or the holding mechanism 106 can be configured to allow variable placement and selective fastening to any of multiple positions (defined or variable) along a height extending at least a portion of from one or both ends of the stem element 104, which can be selectively fixed in a desired location by a gear/ratchet structure, one or more set screws, and/or the like.

Embodiments of a flotation device described herein can have a front-back centerline $CL_{FB}$ defined by one or more features of the flotation device. Illustrative features that can define the front-back centerline $CL_{FB}$ of a flotation device include one or more of: a shape of the flotation element 102, a shape of the stem element 104 (e.g., an elongate lateral cross-section), a connection point between the flotation element 102 and the stem element 104 (e.g., can be located closer to the back or front), an orientation of the stem element 104 with respect to the flotation element 102 (e.g., can be oriented toward the back), a shape and/or orientation of the holding mechanism 106 (e.g., can define the lateral sides of the device), and/or the like. However, it is understood that embodiments of a flotation device described herein can have no inherent feature that defines a front/back, a left/right, and/or a top/bottom.

Figure 2A:
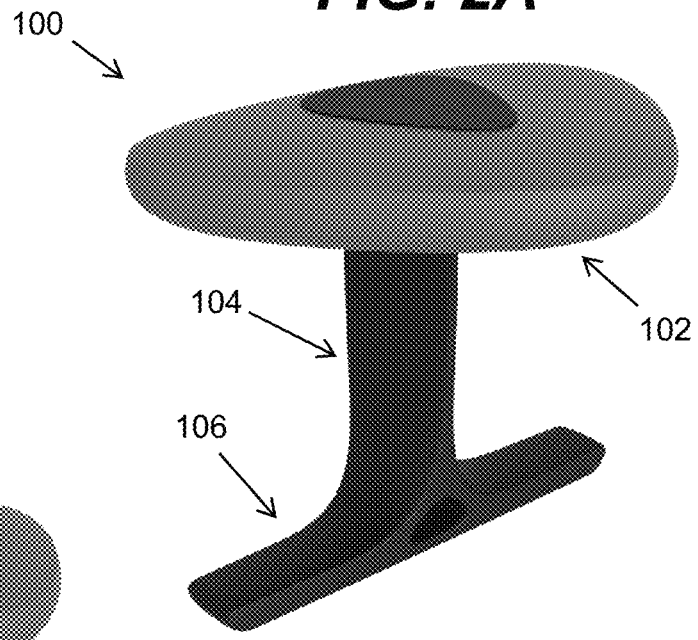
Figure 2B:
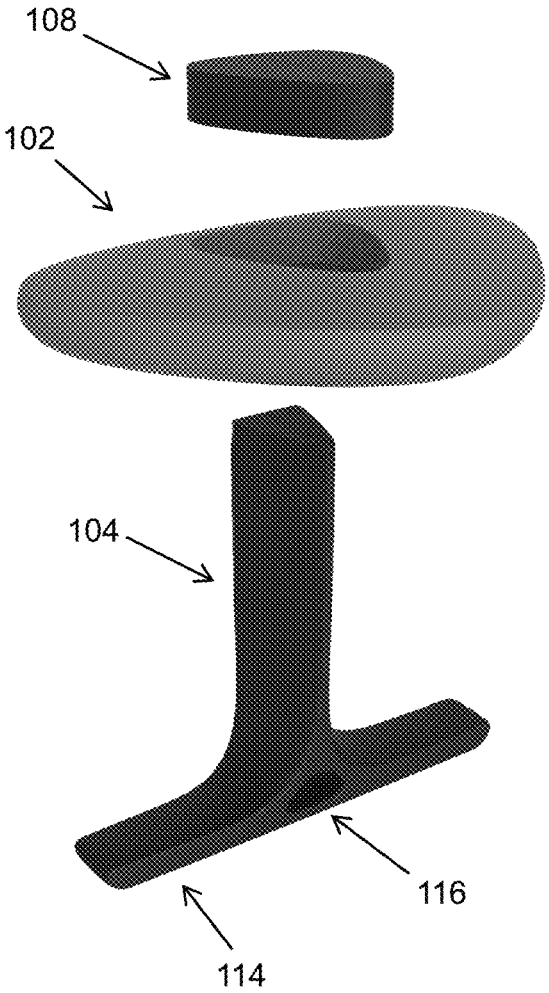
Figure 2C:
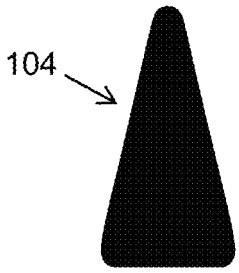
FIGS. 2C-2D show lateral cross-sectional views of the stem according to embodiments.

FIGS. 2A-2B show a perspective and exploded view, respectively, of a three piece flotation device 100 including a triangular flotation element 102, a triangular stem element 104, and a triangular locking piece 108 according to an embodiment, while FIG. 2C shows a lateral cross-sectional view of the stem element 104 according to an embodiment. In this case, the stem element 104 and the holding mechanism 106 comprise a single molded piece, while the flotation element 102 is another piece. The locking piece 108 can be sized to be inserted into an opening in the flotation element 102 and be held secure in place via surface tension, glue, and/or the like. The locking piece 108 can include an opening, which is sized to enable an end of the stem element 104 to be inserted therein and held secure in place via surface tension, glue, and/or the like.

In an embodiment, the locking piece 108 and the opening in the flotation element 102 have complementary shapes that only allow the locking piece 108 to be inserted into the opening in a single direction. Similarly, the opening on the locking piece 108 and the stem element 104 can have complementary shapes such that the stem element can only be mounted in a single direction. Alternatively, one or both of the openings and corresponding shapes of the components can be configured to allow the corresponding component to be inserted in any one of multiple directions. For example, an opening and the corresponding shape can be configured to allow the component to be selectively inserted facing a forward direction or a backward direction. In this case, the components can be secured to each other using a solution that allows for the removal and reinsertion of the corresponding component.

Figure 3A:
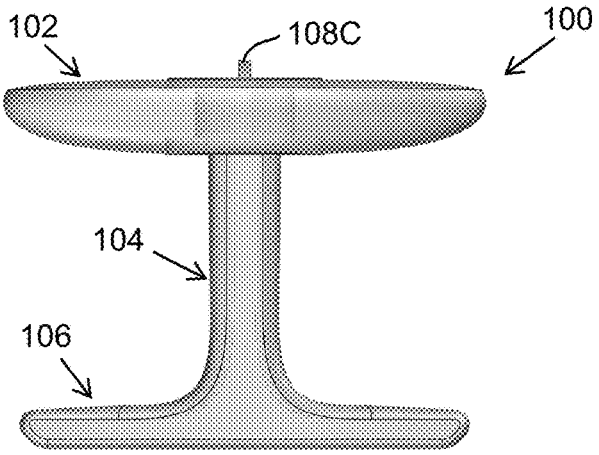
FIGS. 3A-3C show front, side, and exploded views of a three piece flotation device according to another embodiment.
Figure 3B:
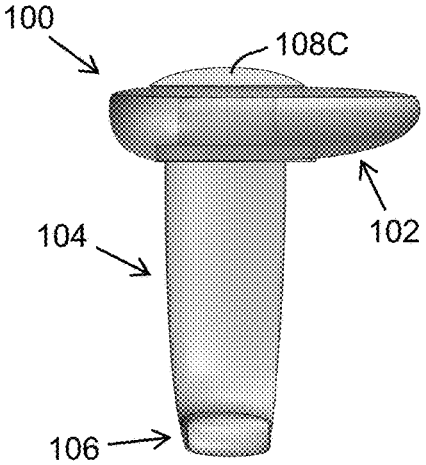
Figure 3C:
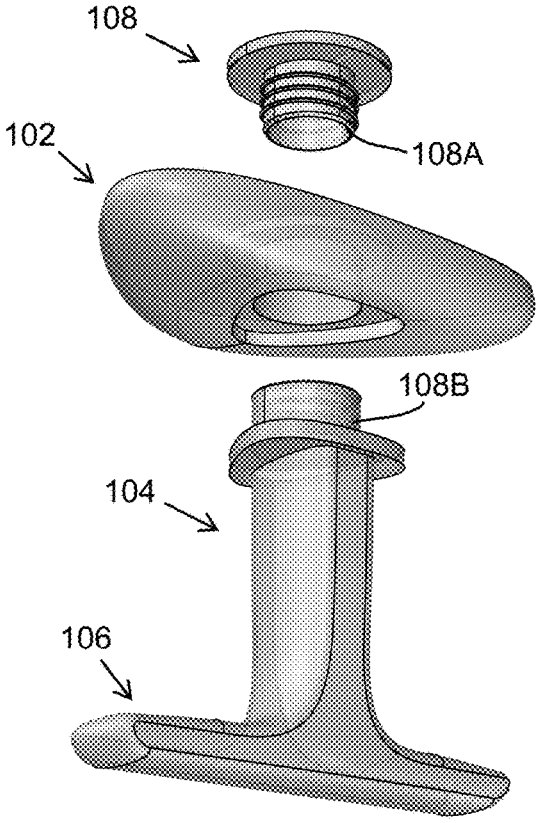

It is understood that use of the locking piece 108 connecting the stem 104 to the flotation element 102 is only illustrative. In other embodiments, the flotation device 100 could be built as a single piece or two piece device. Additionally, the pieces could connect in alternate ways. For example, FIGS. 3A-3C show front, side, and exploded views, respectively, of a three piece flotation device 100 according to another embodiment. In this case, the stem element 104 connects to the locking piece 108 using a male/female threaded connector 108A, 108B. Additionally, the locking piece 108 is shown including a vertical extension 108C, which can enable a user to rotate the locking piece 108 in order to attach or detach the stem element 104 therefrom. As shown most clearly in FIG. 3C, the flotation element 102 can have an opening that prevents the stem element 104 from rotating when inserted therein. The opening also can limit an extent to which the stem element 104 can be inserted and include a second portion that has a complementary shape to the locking piece 108.

In addition to other materials, a variety of foam, plastic, and rubber combinations may be implemented for any of the embodiments. Furthermore, flotation may be achieved using a foam, rubber, or even hollow plastic or carbon structure.

As illustrated most clearly in FIG. 2C, a lateral cross section of the stem element 104 can be tapered, e.g., from front to back. In an embodiment, the stem element 104 has a lateral front-back height that is approximately twice a lateral left-right width. However, it is understood that this is only illustrative. In embodiments, the stem element 104 can have a lateral front-back height that is anywhere between approximately the same as a lateral left-right width to approximately three times the lateral left-right width. In another more particular illustrative embodiment, the stem element 104 has a lateral front-back height that is approximately thirty percent larger than the lateral left-right width.

Figure 2D:
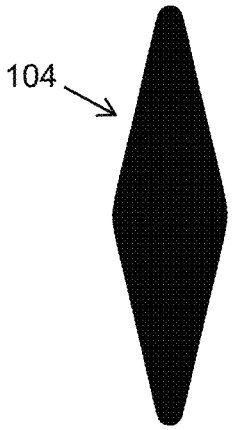

The tapered shape offers hydrodynamics when the flotation device 100 is used as a kick board. When the flotation device is turned around and used as a pull buoy, the tapered shape will encourage the stem 104 to move towards the waist when the flotation device 100 is squeezed between the swimmer's thighs. FIG. 2D shows an alternative lateral cross section of the stem element 104. In this case, the stem element 104 is widest in a central region and tapers both towards the front and the back from the central region. The lateral front-back height can be approximately two to five times the lateral left-right width of the stem element 104. This configuration can, for example, provide additional comfort for the swimmer when the flotation device 100 is used as a pull buoy. It is understood that the lateral cross-sections shown in FIGS. 2C and 2D are only illustrative of various cross-sections that include a taper. For example, a stem 104 can have an oval (egg-shaped) lateral cross-section, a trapezoidal lateral cross-section, and/or the like.

The protrusions 114 of the holding mechanism 106 located at the bottom of the stem 104 can be placed under the swimmer's thighs when the flotation device 100 is used as a pull buoy. In this case, the flotation device 100 can be located such that the front side of the flotation device is located toward the swimmer's feet.

The holding mechanism 106 at the bottom of the stem 104 may be used as a hand hold when the flotation device 100 is used as a kickboard. Similar to the stem element 104, protrusions 114 may be tapered for hydrodynamics. As discussed herein, the swimmer can grasp the protrusions 114, or the hole 116 located at the bottom of the stem element 104 may be used as a handhold, when the flotation device 100 is used as a kickboard. A handle or grip could also be built into the vertical part of the stem element 104. In an embodiment, the holding mechanism 106 can be selectively removed from and attached to the stem element 104. For example, the holding mechanism 106 can be attached to the stem element 104 when the flotation device 100 is used as a pull buoy, and removed from the stem element 104 when the flotation device 100 is to be used as a kickboard.

Figure 4A:
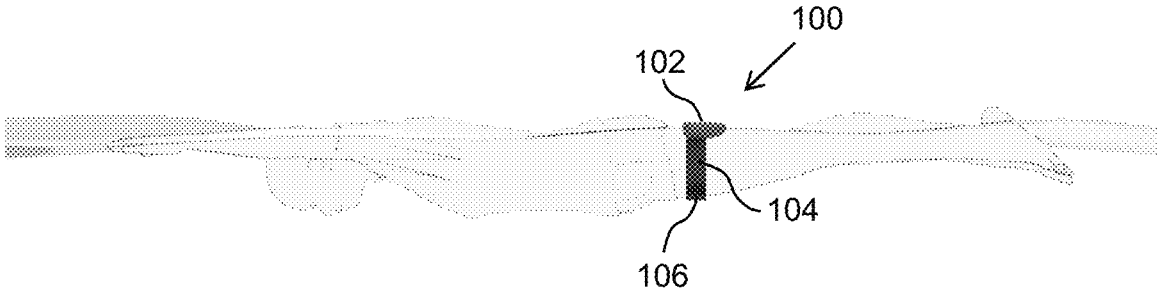
FIGS. 4A and 4B show a swimmer using an illustrative flotation device in between his/her thighs as a pull buoy or at arm's length as a kickboard according to embodiments.
Figure 4B:
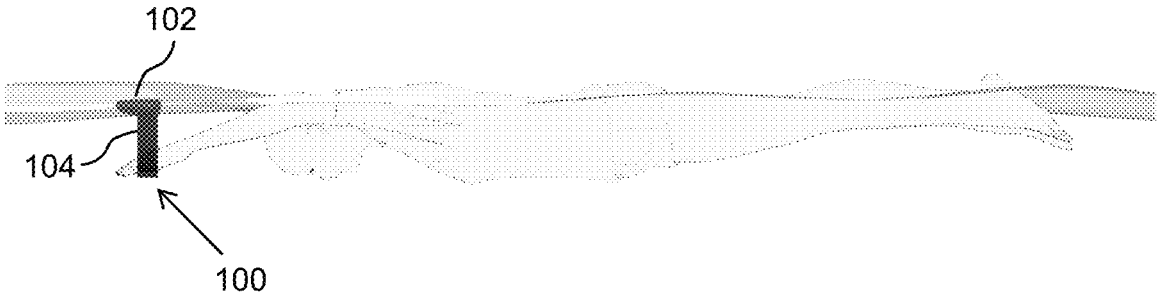

FIGS. 4A and 4B show a swimmer using the flotation device 100 alternately as a pull buoy and as a kickboard, respectively. In the pull buoy implementation shown in FIG. 4A, the stem element 104 of the flotation device 100 fits between the thighs. The flotation element 102 can be located at the water surface level with the holding mechanism 106 located on the bottom, or the flotation device 100 can be inverted. In the kickboard implementation shown in FIG. 3B, the swimmer reaches forward and rests at least one hand on the stem element 104 and/or the holding mechanism 106, if utilized. The swimmer may also hold the flotation element 102 located at a water surface level, if desired.

Figure 5A:
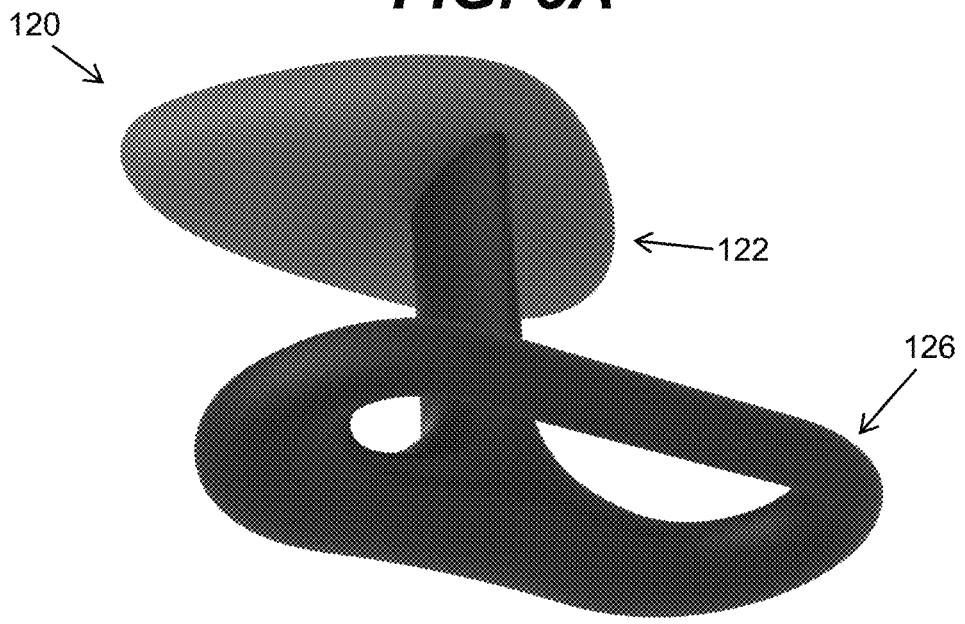
FIGS. 5A-5C show a perspective view of another flotation device and a swimmer using the flotation device in alternative configurations according to another embodiment.
Figure 5B:
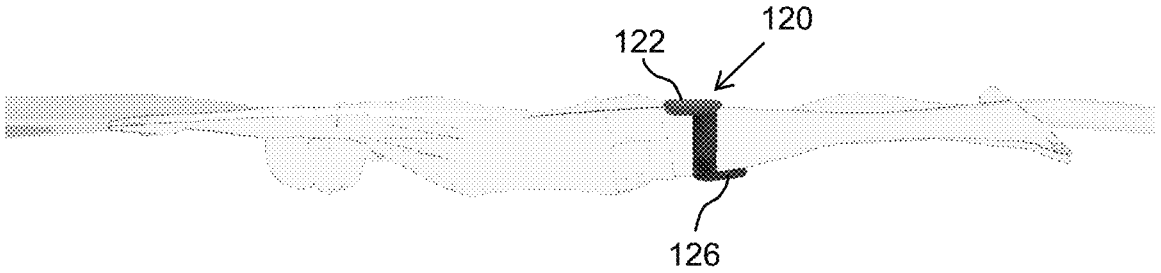
Figure 5C:
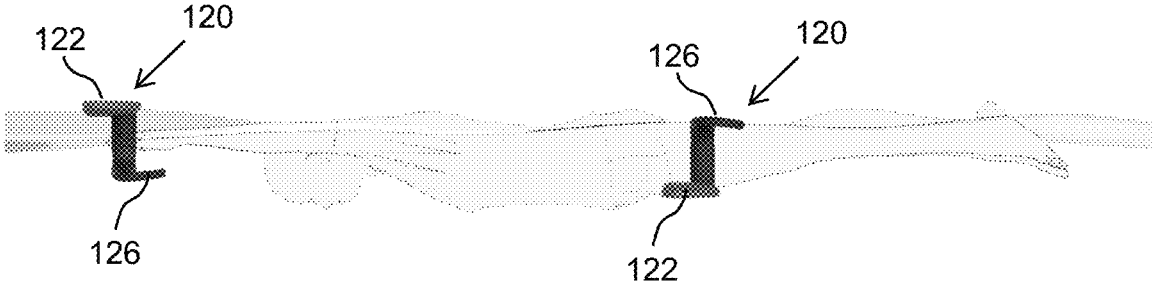

Various other embodiments of a flotation device described herein are possible. To this extent, FIG. 5A shows an embodiment of a flotation device 120 with a more substantial holding mechanism 126, e.g., in the form of a handle having an elliptical or rounded rectangular shape. In FIG. 5B, the flotation element 122 is shown located on a surface side of the water, above the swimmer's thighs. In FIG. 5C, the flotation device 120 is shown alternately with the flotation element 122 located underwater, below the swimmer's thighs. FIG. 5C also depicts how the flotation device 120 can be used as a kickboard.

Figure 6A:
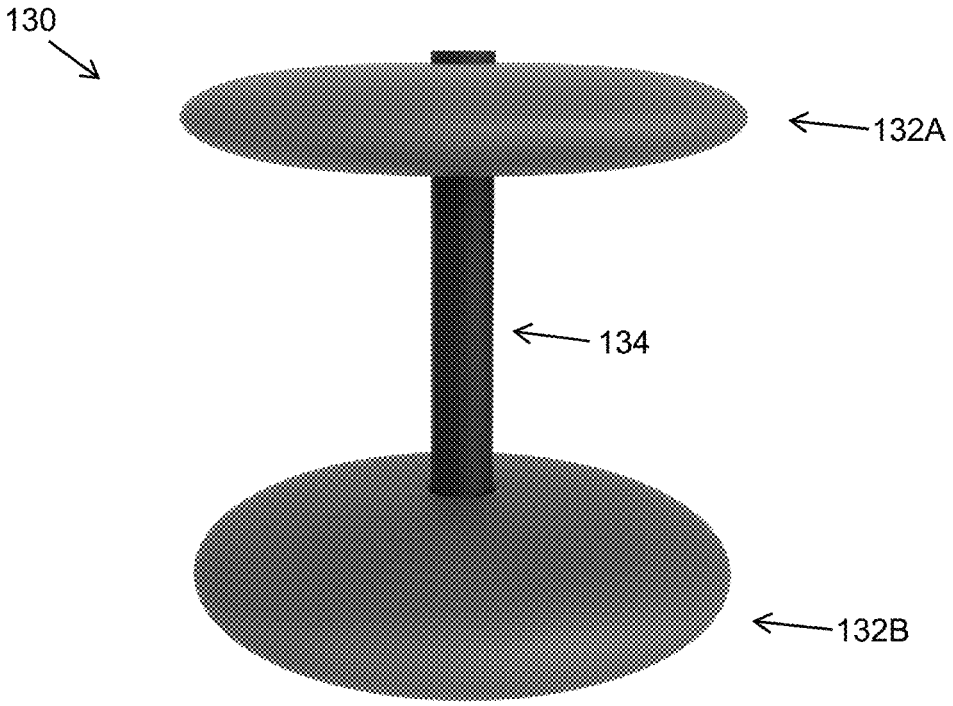
FIGS. 6A-6C show a perspective view of still another flotation device and a swimmer using the flotation device in alternative configurations according to still another embodiment.
Figure 6B:
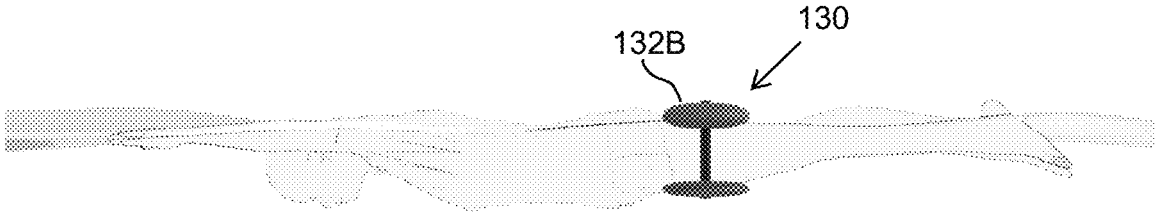
Figure 6C:
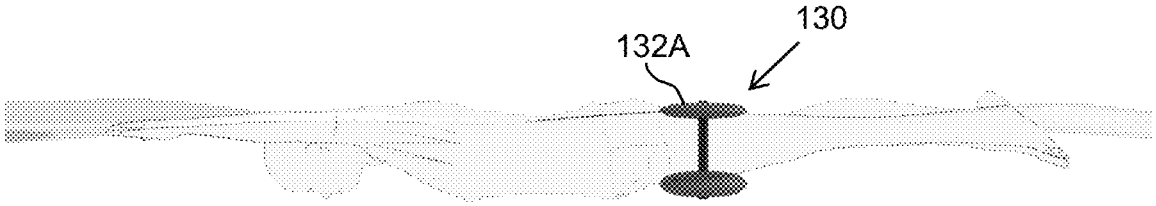

FIG. 6A shows an embodiment of a flotation device 130 that includes two flotation elements 132A, 132B and a stem element 134 located there between. The flotation elements 132A, 132B can be configured similarly, or one flotation element, such as the flotation element 132B, can be larger than the other flotation element, such as the flotation element 132A. FIGS. 6B and 6C show how the orientation of this embodiment of a flotation device 130 could be used with either flotation element 132A, 132B on the top or bottom. In an embodiment, the stem element 134 can have an elliptical (e.g., circular) lateral cross-section. Alternatively, the stem element 134 can have a lateral cross-section as shown and described herein, e.g., including one or more tapered regions (e.g., forming a triangular, diamond-shaped, oval, trapezoidal, and/or the like, lateral cross-section).

Figure 7A:
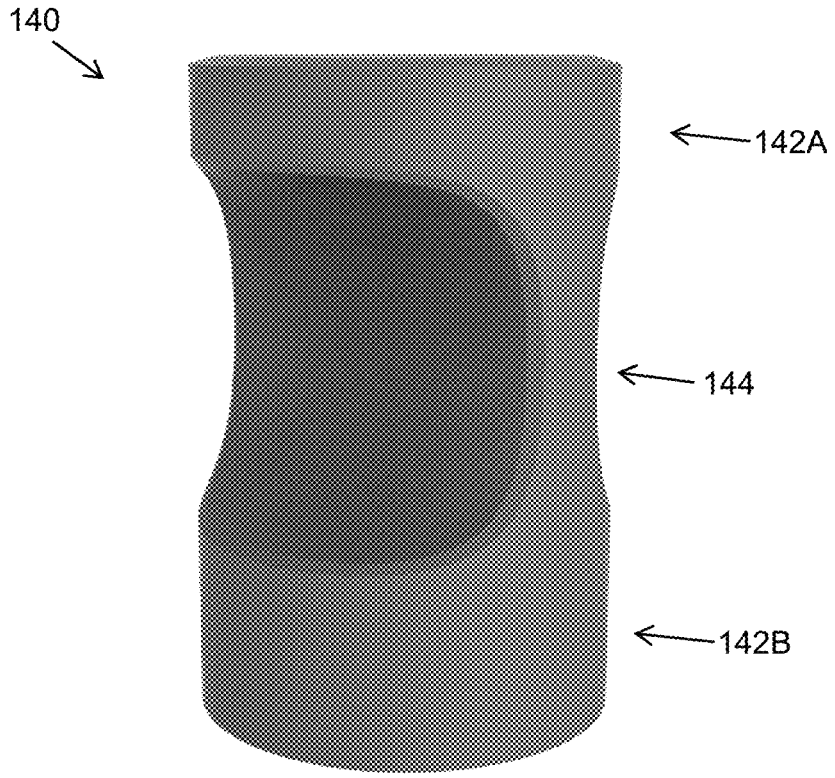
FIGS. 7A-7C show a perspective view of a flotation device and a swimmer using the flotation device as a pull buoy in alternative configurations according to another embodiment.
Figure 7B:
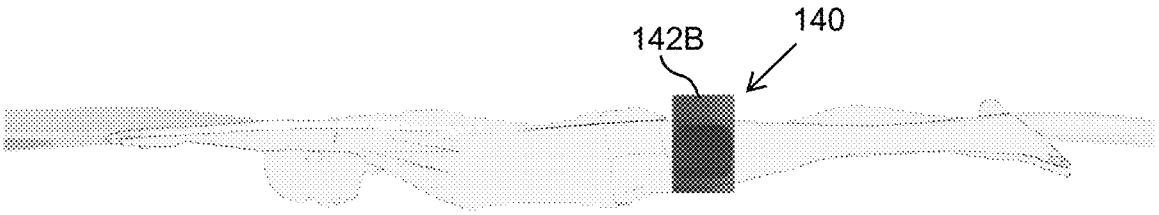
Figure 7C:
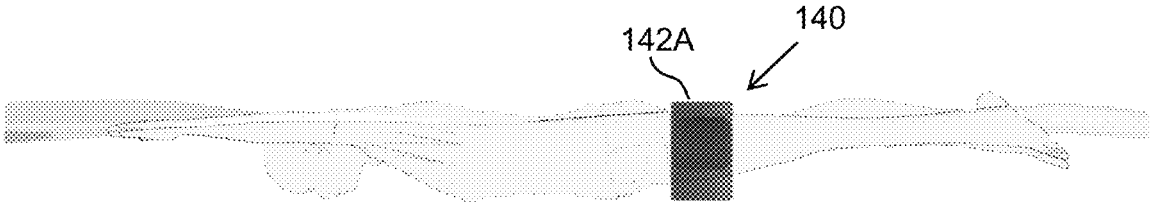
Figure 8A:
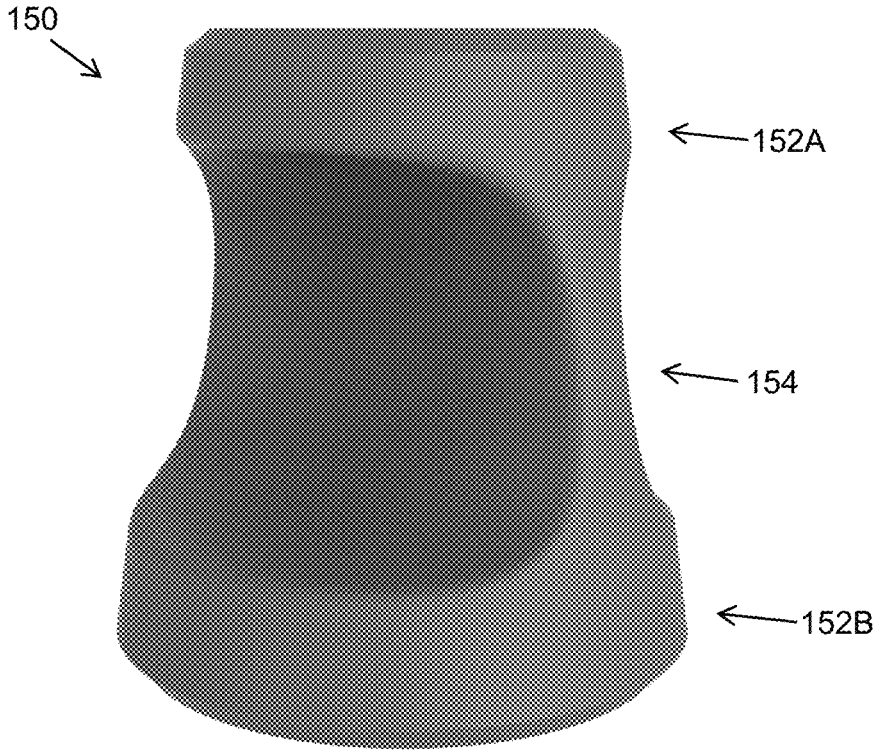
FIGS. 8A-8C show a perspective view of another flotation device and a swimmer using the flotation device as a pull buoy in alternative configurations according to another embodiment.
Figure 8B:
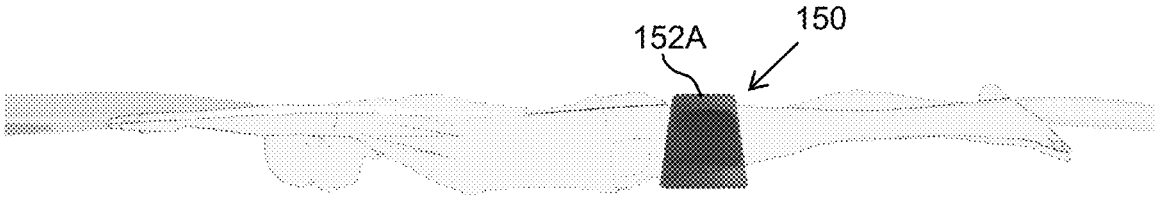
Figure 8C:
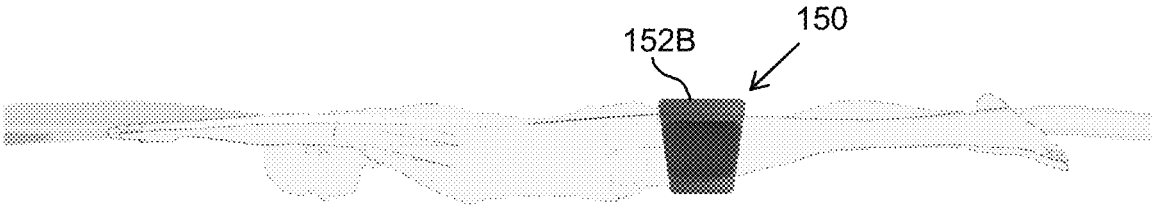
Figure 9A:
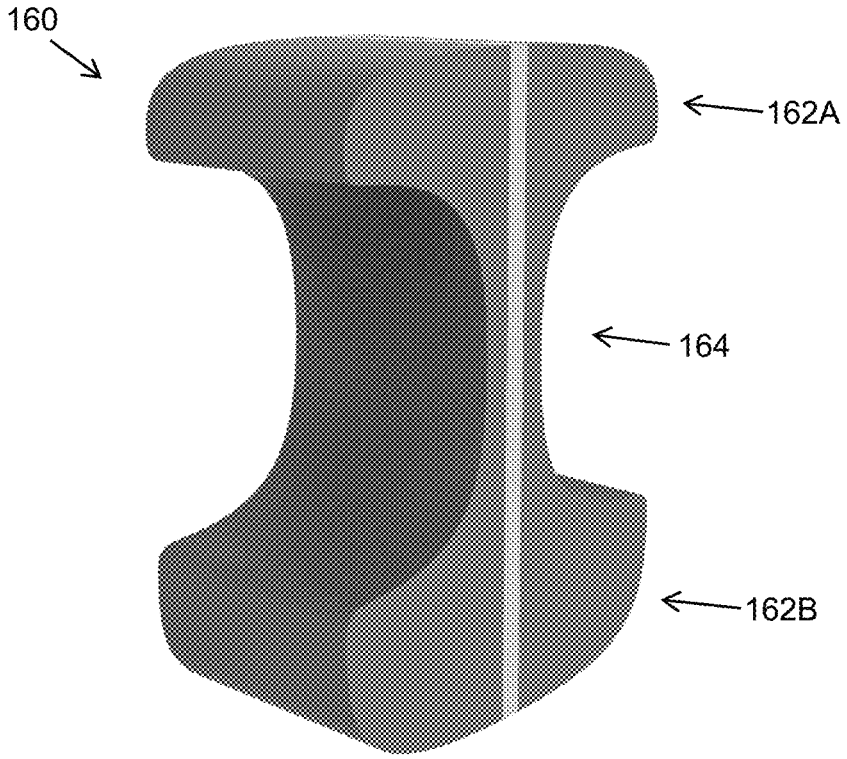
FIGS. 9A-9C show a perspective view of still another flotation device and a swimmer using the flotation device as a pull buoy in alternative configurations according to still another embodiment.
Figure 9B:
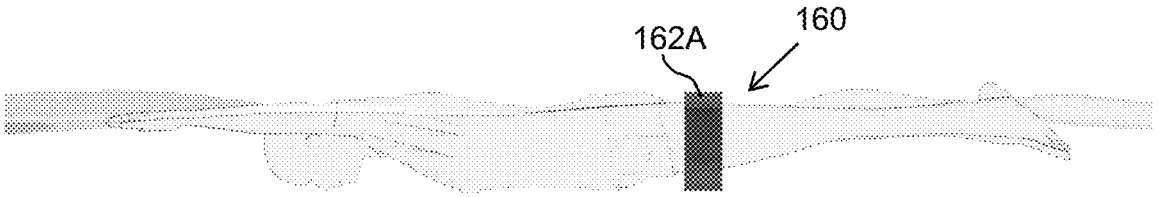
Figure 9C:
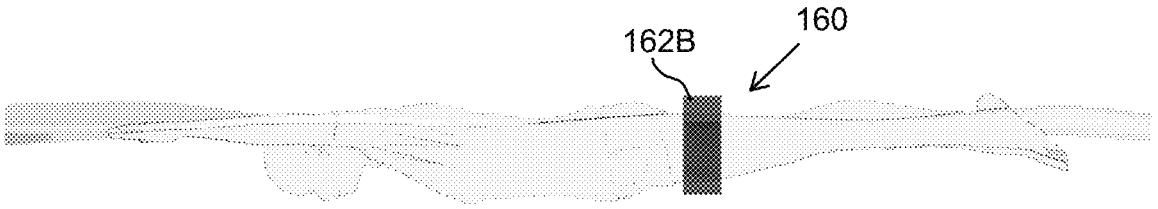

FIGS. 7A, 7B, 7C, 8A, 8B, 8C, 9A, 9B, and 9C show still further alternate embodiments of flotation devices that are configured to provide a snug fit between the legs of the swimmer and a shape where the water flow also provides the rotational torque to secure the device better than the traditional figure-8 pull buoy designs.

In FIGS. 7A-7C, the flotation device 140 includes a narrowed central section 144 forming a stem element, with wider top and bottom flotation elements 142A, 142B. Similarly, in FIGS. 8A-8C, the flotation device 150 includes a narrowed central section 154 forming a stem element, with wider top and bottom flotation elements 152A, 152B. Similarly, in FIGS. 9A-9C, the flotation device 160 includes a narrowed central section 164 forming a stem element, with wider top and bottom flotation elements 162A, 162B. As illustrated in each of these embodiments, the flotation device 140, 150, 160 can include one flotation element that is larger than the other, and as also shown and described with respect to the flotation device 130 in FIGS. 6A-6C, either flotation element can be located on the water surface when used by a swimmer. In each embodiment, the narrowed central section 144, 154, 164 forming the stem element can have a rectangular lateral cross-section. Alternatively, the narrowed central section 144, 154, 164 can have a lateral cross-section as shown and described herein, e.g., including one or more tapered regions (e.g., forming a triangular, diamond-shaped, oval, trapezoidal, and/or the like, lateral cross-section).

In each of the flotation device embodiments shown and described herein, a stem element is configured to be held between a swimmer's legs. The stem element can be tapered such that, at least the portion of the stem element located between the swimmer's legs tapers from a side closer the swimmer's waist towards a side closer to the swimmer's feet. Such tapering can provide a force that pushes the flotation device towards the swimmer's waist during use, which results in the flotation device remaining in place easier than with prior art pull buoys.

As used herein, terms of degree such as "about" and "approximately," mean a reasonable amount of deviation of the modified term such that the end result is not significantly changed. In an embodiment, these terms can be construed as including a deviation of ±10% of the modified term when this deviation would not negate the meaning of the word it modifies.

The foregoing description of various aspects of the invention has been presented for purposes of illustration and description. The exact form of the buoy may vary. The description is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A flotation device comprising:

a flotation element having an inner surface;

a stem element having a first end extending from the inner surface of the flotation element, wherein the stem element is formed of a rigid material, and wherein a primary axis of the stem element is approximately perpendicular to the flotation element along a front-back centerline of the flotation device; and a holding mechanism located adjacent to a second end of the stem element, opposite the first end, wherein the holding mechanism comprises horizontal protrusions extending from lateral sides of the stem element, and wherein, when the stem element is located between the thighs of a user for use of the flotation device as a pull buoy, the flotation element and the protrusions are configured to contact a front and a back of each thigh of the user to lock the pull buoy into place.

2. A flotation device comprising:

a flotation element having an inner surface;

a stem element having a first end extending from the inner surface of the flotation element, wherein the stem element is formed of a rigid material, and wherein a primary axis of the stem element is approximately perpendicular to the flotation element along a front-back centerline of the flotation device; and a holding mechanism located adjacent to a second end of the stem element, opposite the first end, wherein the holding mechanism comprises an opening located adjacent the second end of the stem element.

3. The device of claim 1, wherein the inner surface of the flotation element tapers from the back side toward the front side of the inner surface.

4. The device of claim 1, wherein at least a portion of the stem element has a lateral cross section having an approximate shape of one of: a triangle, a parallelogram, a trapezoid, or an oval.

5. The device of claim 1, wherein the flotation element is formed from at least one of: silicone, polyethylene foam, ethylene-vinyl acetate (EVA), or neoprene.

6. The device of claim 1, wherein the inner surface of the flotation element has a surface area of about 45 square inches.

7. The device of claim 1, wherein a height and a width of the inner surface of the flotation element are between approximately six inches and approximately twelve inches.

8. The device of claim 1, wherein the primary axis of the stem element has a length between approximately one half a left-right width of the flotation element and approximately one and one-third the left-right width of the flotation element.

9. The device of claim 8, wherein the length of the primary axis of the stem element is between approximately six inches and approximately twelve inches.

10. The device of claim 1, wherein the protrusions each extend horizontally between approximately three inches and approximately fourteen inches.

11. The device of claim 1, wherein the protrusions taper from the back of the protrusions towards the front side.

12. The device of claim 1, wherein the stem element extends from a location on the inner surface closer to a back side of the inner surface.

13. A flotation device, comprising:

a stem element configured to be held between a swimmer's legs when the flotation device is used as a pull buoy, wherein at least a portion of the stem element has an approximately triangular or trapezoidal lateral cross section that tapers from an end of the stem element located between the swimmer's leg's closer to the swimmer's waist to an end of the stem element located closer to the swimmer's feet.

14. The flotation device of claim 13, wherein the portion of the stem element has rounded corners.

15. The flotation device of claim 13, further comprising at least one protrusion extending approximately perpendicular to the primary axis of the stem element.

16. A flotation device comprising:

a flotation element having an inner surface with a front side and a back side, wherein the flotation element is configured to be located at a surface of the water during use of the flotation device and has a lateral width between approximately five inches and approximately twenty-four inches;

a stem element having a first end extending from the inner surface of the flotation element, wherein a primary axis of the stem element is approximately perpendicular to the flotation element along a front-back centerline of the flotation element; and a holding mechanism located adjacent to a second end of the stem element, opposite the first end, wherein the holding mechanism includes a pair of horizontal protrusions configured to be located below the surface of the water during use of the flotation device, each horizontal protrusion extending from a lateral side of the stem element between approximately three inches and approximately fourteen inches;

wherein, when the stem element is located between the thighs of a user for use of the flotation device as a pull buoy, the flotation element and the horizontal protrusions are configured to contact a front and a back of each thigh of the user to lock the pull buoy into place.

17. The flotation device of claim 16, further comprising a locking piece, wherein the stem element is secured to the locking piece through an opening in the flotation element.

18. The flotation device of claim 16, wherein a height and a width of the inner surface of the flotation element are between approximately six inches and approximately twelve inches.

19. The flotation device of claim 16, wherein the flotation element has an approximately lateral triangular or trapezoidal shape that tapers from one of: a front side of the flotation device or a back side of the flotation device to the other of: the front side or the back side of the flotation device.

20. The flotation device of claim 13, further comprising a flotation element having an inner surface, wherein the stem element has a first end extending from the inner surface of the flotation element.

21. The flotation device of claim 20, further comprising a protrusion extending laterally from the stem element approximately perpendicular to the primary axis of the stem element adjacent to a second end of the stem element, opposite the first end, wherein, when the stem element is located between the thighs of a user for use of the flotation device as a pull buoy, the flotation element and the protrusion are configured to contact a front and a back of a thigh of the user to lock the pull buoy into place.

* * * * *